US010897090B2

(12) United States Patent
Navarro et al.

(10) Patent No.: US 10,897,090 B2
(45) Date of Patent: Jan. 19, 2021

(54) ELECTRONICS AND FILTER-INTEGRATED, DUAL-POLARIZED TRANSITION AND RADIATOR FOR PHASED ARRAY SENSORS

(71) Applicant: The Boeing Company, Chicago, IL (US)

(72) Inventors: Julio A. Navarro, Renton, WA (US); Paul C. Werntz, Long Beach, CA (US); Philip R. Grajek, Redondo Beach, CA (US); Paul J. Tatomir, Palm Desert, CA (US); James M. Barker, Torrence, CA (US); Xu Luo, Cerritos, CA (US)

(73) Assignee: The Boeing Company, Chicago, IL (US)

( * ) Notice: Subject to any disclaimer, the term of this patent is extended or adjusted under 35 U.S.C. 154(b) by 14 days.

(21) Appl. No.: 16/277,908

(22) Filed: Feb. 15, 2019

(65) Prior Publication Data

US 2020/0266548 A1 Aug. 20, 2020

(51) Int. Cl.

| | |
|---|---|
| ***H01Q 13/00*** | (2006.01) |
| ***H01Q 21/00*** | (2006.01) |
| ***H01Q 15/24*** | (2006.01) |
| ***H01Q 13/18*** | (2006.01) |
| *H01P 1/213* | (2006.01) |
| *H01P 7/06* | (2006.01) |
| *H01P 11/00* | (2006.01) |

(52) U.S. Cl.

CPC ..... *H01Q 21/0056* (2013.01); *H01Q 13/18* (2013.01); *H01Q 15/24* (2013.01); *H01Q 21/0087* (2013.01); *H01P 1/2138* (2013.01); *H01P 7/06* (2013.01); *H01P 11/007* (2013.01); *H01Q 21/0037* (2013.01)

(58) Field of Classification Search

CPC ..... H01Q 21/0037; H01P 7/06; H01P 11/007; H01P 1/2138

USPC ..... 343/772

See application file for complete search history.

(56) References Cited

U.S. PATENT DOCUMENTS 5,517,203 A * 5/1996 Fiedziuszko ..... H01P 1/2086 333/202

2006/0158382 A1* 7/2006 Nagai ..... H01Q 21/0037 343/786

(Continued)

*Primary Examiner* — Thuy Vinh Tran

(74) *Attorney, Agent, or Firm* — McDonnell Boehnen Hulbert & Berghoff LLP

(57) ABSTRACT

In examples, systems and methods for waveguide antenna arrays with integrated filters are described. An example waveguide antenna array element a waveguide section has a first end and second end. The waveguide section is configured to propagate electromagnetic energy. The waveguide antenna array element also includes a feed configured to launch an electromagnetic wave into the first end of the waveguide section. The waveguide antenna array element also includes a waveguide filter having at least one waveguide cavity coupled to the second end of the waveguide section. The waveguide filter is configured to pass a first set of electromagnetic frequencies and reject a second set of electromagnetic frequencies. Yet further, the waveguide antenna array element includes an antenna coupled to the waveguide filter configured to radiate a portion of the electromagnetic energy passed by the waveguide filter.

20 Claims, 9 Drawing Sheets

(56) References Cited

U.S. PATENT DOCUMENTS

2010/0231475 A1* 9/2010 Ou ..... H01Q 13/0258
343/776
2011/0254641 A1* 10/2011 Kunes ..... H01P 1/2138
333/208

* cited by examiner

ELECTRONICS AND FILTER-INTEGRATED, DUAL-POLARIZED TRANSITION AND RADIATOR FOR PHASED ARRAY SENSORS

FIELD

Embodiments of the present disclosure relate generally to antennas. More particularly, embodiments of the present disclosure relate to antenna structures including the associated feed structures.

BACKGROUND

Radio systems generally operate with a desired frequency within predefined frequency bands. Various frequency bands may have specific dedicated use cases. For example, cellular phones, radio astronomy, and aircraft communications each have dedicated frequency bands. When operating a radio system in a given band, it is desired to prevent spurious radio transmissions in other bands and at frequencies other than the desired frequency.

The antennas of the radio system may be able to both transmit and receive radio signals. The antennas may be arranged in an array of antennas. An array may be an arrangement of antennas that have a physical layout that produces desirable antenna properties. For example, antennas may arranged in a linear array with the antennas aligned on a line, a two dimensional array with the antennas aligned on a plane, or other possible antenna array arrangements as well. The array may enable beam steering of signals transmitted and received by the antenna array.

SUMMARY

In one example, a waveguide antenna array element is described. The waveguide antenna array element includes a waveguide section having a first end and second end. The waveguide section is configured to propagate electromagnetic energy. The waveguide antenna array element also includes a feed configured to launch an electromagnetic wave into the first end of the waveguide section. The waveguide antenna array element also includes a waveguide filter having at least one resonant waveguide cavity coupled to the second end of the waveguide section. The waveguide filter is configured to pass a first set of electromagnetic frequencies and reject a second set of electromagnetic frequencies. Yet further, the waveguide antenna array element includes an antenna coupled to the waveguide filter configured to radiate a portion of the electromagnetic energy passed by the waveguide filter.

In another example, a method of radiating an electromagnetic signal is described. The method includes feeding electromagnetic energy to a first end of a waveguide section by a feed. The method also includes propagating the electromagnetic energy along the waveguide section from the first end to a second end. Further, the method includes filtering the electromagnetic energy by at least one waveguide filter coupled to the second end of the waveguide. The at least one waveguide filter is configured to pass a first set of electromagnetic frequencies and reject a second set of electromagnetic frequencies. The method additionally includes radiating a portion of the electromagnetic energy passed by the waveguide filter by an antenna coupled to the waveguide filter.

In one yet another example, a waveguide antenna array is disclosed. The waveguide antenna array includes a plurality of radiating elements arranged in an array. Each radiating element includes a waveguide section having a first end and second end. The waveguide section is configured to propagate electromagnetic energy. Each radiating element also includes a feed configured to launch an electromagnetic wave into the first end of the waveguide section. Each radiating element also includes a waveguide filter having at least one resonant waveguide cavity coupled to the second end of the first waveguide section. The waveguide filter is configured to pass a first set of electromagnetic frequencies and reject a second set of electromagnetic frequencies. Each radiating element further includes an antenna coupled to the waveguide filter configured to radiate a portion of the electromagnetic energy passed by the waveguide filter. Additionally, the feed of each radiating element has an associated rotation based on a location of the radiating element in the array.

The features, functions, and advantages that have been discussed can be achieved independently in various embodiments or may be combined in yet other embodiments further details of which can be seen with reference to the following description and drawings.

BRIEF DESCRIPTION OF THE FIGURES

Example novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Disclosed embodiments will now be described more fully hereinafter with reference to the accompanying drawings, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

As previously discussed, when operating a radio system in a given frequency band, it is desired to prevent spurious radio transmissions in other frequency bands and at frequencies other than the desired frequency. When operating a radio system, transmission components, such as a signal generator and/or amplifier may introduce undesired signals outside the given band. These undesired signals, if radiated by the radio system, are called spurious emissions. Spurious emissions may cause a radio system to interfere with other radio systems operating outside the given frequency band. Therefore, it is desirable to create a radio system that prevents the transmission of spurious emissions (i.e., signals outside the given frequency band of operation for the radio system). Further, there may also be legal requirements that require spurious emissions to be lower than a predetermined threshold value.

In conventional systems, complicated filtering hardware may be used near antenna feeds to prevent signals outside the given band from being transmitted. However, the filtering hardware (which may include filters, baluns, among other hardware) may be bulky, expensive, complicated to manufacture, and heavy. Thus, it may be desirable to prevent the transmission of undesired radio signals by other means. The presently-disclosed antenna system includes a waveguide filter integrated within the antenna structure that prevents the transmission of signals outside the desired frequency band.

Figure 1A:
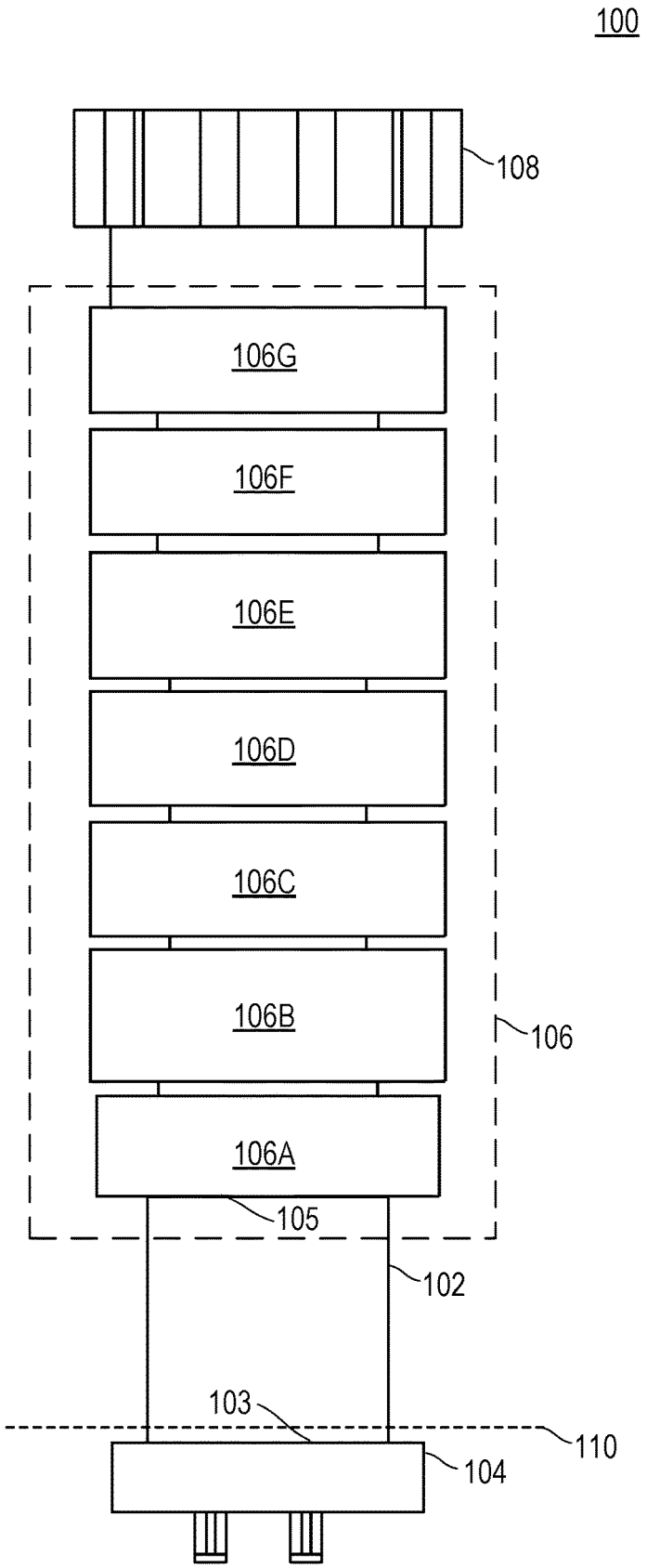
FIG. 1A illustrates an example waveguide antenna element, according to an example embodiment.

Referring now to the figures, FIG. 1A illustrates an example of a waveguide antenna array element 100, according to an example embodiment. The waveguide antenna array element 100 includes a waveguide section 102, a feed 104, a waveguide filter 106 comprising filter cavities 106A-106G, and an antenna 108. The waveguide antenna array element 100 may also include a simulation plane 110. The waveguide antenna array element 100 may be one antenna element that makes up an array of antenna elements, each being the same as waveguide antenna array element 100.

The waveguide antenna array element 100 may be built out of air-filled (i.e., hollow) waveguides. Thus, the waveguide section 102, the waveguide filter 106, filter cavities 106A-106G, and the antenna 108 may be hollow space and FIG. 1A shows the outline each of these components. In some examples, expanded further with respect to other figures, the waveguide antenna array element 100 may be built through a metallic layered construction, additive manufacturing, or a split-block construction. Because the waveguide antenna array element 100 has a hollow waveguide construction, including waveguide filter 106, it may be more lightweight than a conventional antenna that includes radio filtering components.

The waveguide section 102 may be a circular hollow waveguide. The waveguide section may include a first end 103 coupled to the feed 104 and a second end 105 coupled to the waveguide filter 106. The waveguide section 102 is configured to propagate electromagnetic signals fed into the waveguide section 102 by the feed 104 to the waveguide filter 106. In some examples, the waveguide section 102 may take a shape other than a circular waveguide. It may be desirable to use a circular waveguide for waveguide section 102 as it is symmetrical. The symmetric nature of the circular waveguide may make some simulations of the antenna system less computationally intense. However, in some other examples, the waveguide section 102 may be a rectangular or square waveguide as well.

The waveguide section 102 may have dimensions that enable electromagnetic signals to propagate in a mode, such a transverse electric mode (TE) or a transverse magnetic mode (TM). It may be desirable for the waveguide section 102 to support propagation of electromagnetic signals at the desired frequency of operation of the waveguide antenna array element 100. Further, based on the shape and dimensions of the waveguide section 102, a cutoff frequency for the waveguide section 102 may be calculated. A cutoff frequency is the lowest frequency that can propagate in a given waveguide. Thus, through selecting dimensions of the waveguide section 102, a cutoff frequency may be chosen to reduce some spurious emissions (i.e., not allow the signals to propagate through the waveguide). In one example, the waveguide section 102 may be cylindrical and have a diameter of 0.420 inches and a length of 0.682 inches.

The feed 104 may be a component that receives electromagnetic signals, such as from electronic components on a circuit board, and launches an electromagnetic wave into the waveguide section 102. The feed may include two ports that provide the electromagnetic signal. By including two ports in the feed 104, the feed 104 may selectively launch one of two different polarizations of signals into the waveguide section 102. In some examples, both feeds may be used simultaneous to launch waves into the waveguide section 102. In some examples, the feed 104 may be called a printed circuit board (PCB) transition, as the port functions to transition signals for radiation by the waveguide antenna array element 100 from a signal in electronic components of a PCB to one in the waveguide section 102. In some examples, the feed 104 may also include some impedance matching components, radio hardware, or other electronics (not shown).

Because the feed 104 uses a port to launch the electromagnetic wave into the waveguide section 102, the port may not be rotationally symmetric like the waveguide section 102. Therefore, as discussed further with respect to FIG. 4B, the port may take on various rotations when an array of antennas is formed.

Waveguide filter 106 is configured to remove signals introduced into the waveguide section 102 from the feed 104 that are not the desired signal (e.g., signals that have frequencies outside of the desired frequencies). In various different examples, the waveguide filter 106 may be more or less complex than that shown in FIG. 1A. As shown in FIG. 1A, the waveguide filter 106 may include seven filter cavities 106A-106G. The waveguide filter 106 may be a bandpass filter, which is a filter that has a predetermined band of frequencies that the waveguide filter 106 allows to pass and the waveguide filter 106 rejects the frequencies outside of the passband. It may be desirable to have a filter with a high quality factor (Q). A high Q filter may have a relatively narrow passband compared to the filter's operational frequency. In some examples, to achieve desired filter performance, at least two high-Q filters may be used. Although FIG. 1A shows a bandpass filter, in other examples, different filters may be used as well, such as low-pass or high-pass filters.

In the example of the waveguide filter 106 shown in FIG. 1A, the waveguide filter 106 may have a passband that enables signals having a frequency between 17.7 to 20.2 gigahertz (GHz) to pass. The waveguide filter 106 may also be designed to have a high rejection of signals having a frequency of 15.4 (or less) and 22.2 GHz (or more). In this example, the signals having a frequency between 17.7 to 20.2 GHz are a first set of frequencies that may be used to transmit from a satellite back to Earth. Because the signals having a frequency of 15.4 and 22.2 GHz are used in radio astronomy, both are highly sensitive to spurious emissions. Therefore, having a filter with high rejection at both 15.4 and 22.2 GHz is desirable to mitigate interference with radio astronomy. The term "high rejection" may mean that the filter provides at least 30 to 40 decibels of signal rejection at the rejection frequencies.

To achieve the desired properties of the waveguide filter 106, the filter may be a seventh-order bandpass filter made of seven different filter cavities 106A-106G. The dimensions of the cavities may be chosen based on the desired passband and stopband characteristics.

The first resonant cavity 106A may have a height of 0.204 inches and a diameter of 0.614 inches. Between the first resonant cavity 106A and the second resonant cavity 106B may be a waveguide portion that has a height of 0.032 inches and a diameter of 0.408 inches. The second resonant cavity 106B may have a height of 0.203 inches and a diameter of 0.631 inches. Between the second resonant cavity 106B and the third resonant cavity 106C may be a waveguide portion that has a height of 0.032 inches and a diameter of 0.361 inches. The third resonant cavity 106C may have a height of 0.208 inches and a diameter of 0.631 inches. Between the third resonant cavity 106C and the fourth resonant cavity 106D may be a waveguide portion that has a height of 0.032 inches and a diameter of 0.348 inches. The fourth resonant cavity 106D may have a height of 0.188 inches and a diameter of 0.631 inches. Between the fourth resonant cavity 106D and the fifth resonant cavity 106E may be a waveguide portion that has a height of 0.032 inches and a diameter of 0.351 inches. The fifth resonant cavity 106E may have a height of 0.201 inches and a diameter of 0.631 inches. Between the fifth resonant cavity 106E and the sixth resonant cavity 106F may be a waveguide portion that has a height of 0.032 inches and a diameter of 0.362 inches. The sixth resonant cavity 106F may have a height of 0.201 inches and a diameter of 0.631 inches. Between sixth resonant cavity 106F and the seventh resonant cavity 106G may be a waveguide portion that has a height of 0.032 inches and a diameter of 0.433 inches. The seventh resonant cavity 106G may have a height of 0.174 inches and a diameter of 0.625 inches. Between seventh resonant cavity 106G and the antenna 108 may be a waveguide portion that has a height of 0.150 inches and a diameter of 0.540 inches.

Although these cavity dimensions are given, within the scope of the invention are other filter designs as well. For example, the waveguide filter 106 may have more or fewer than the seven cavities shown in FIG. 1A. Additionally, the cavity dimensions may be different, based on different filtering parameters.

The antenna 108 may be the component of waveguide antenna array element 100 that radiates signals from the waveguide into free space. The antenna 108 may functionally act as a transformer that transforms the guided electromagnetic wave from the waveguide antenna array element 100 into a free-space propagating wave. The antenna 108 may have a structure that is stepped around the edges (as seen in other figures) rather than being a perfect circle. In one example, the antenna 108 may include steps at 60-degree intervals around the circumference of the circular portion of the antenna. By having stepped edges, further reduction of spurious emissions of higher-order modes may result, as the protrusions prevent the radiation of the higher-order modes. The protrusions may also decrease an antenna-to-antenna coupling between closely spaced antennas. The antenna 108 may have a height of 0.240 inches and a diameter of 0.690 inches.

The simulation plane 110 may not be a physical component of the antenna, but rather a reference point used when doing electromagnetic simulations of the antenna. The simulation plane 110 will be discussed further with respect to FIG. 4B.

Figure 1B:
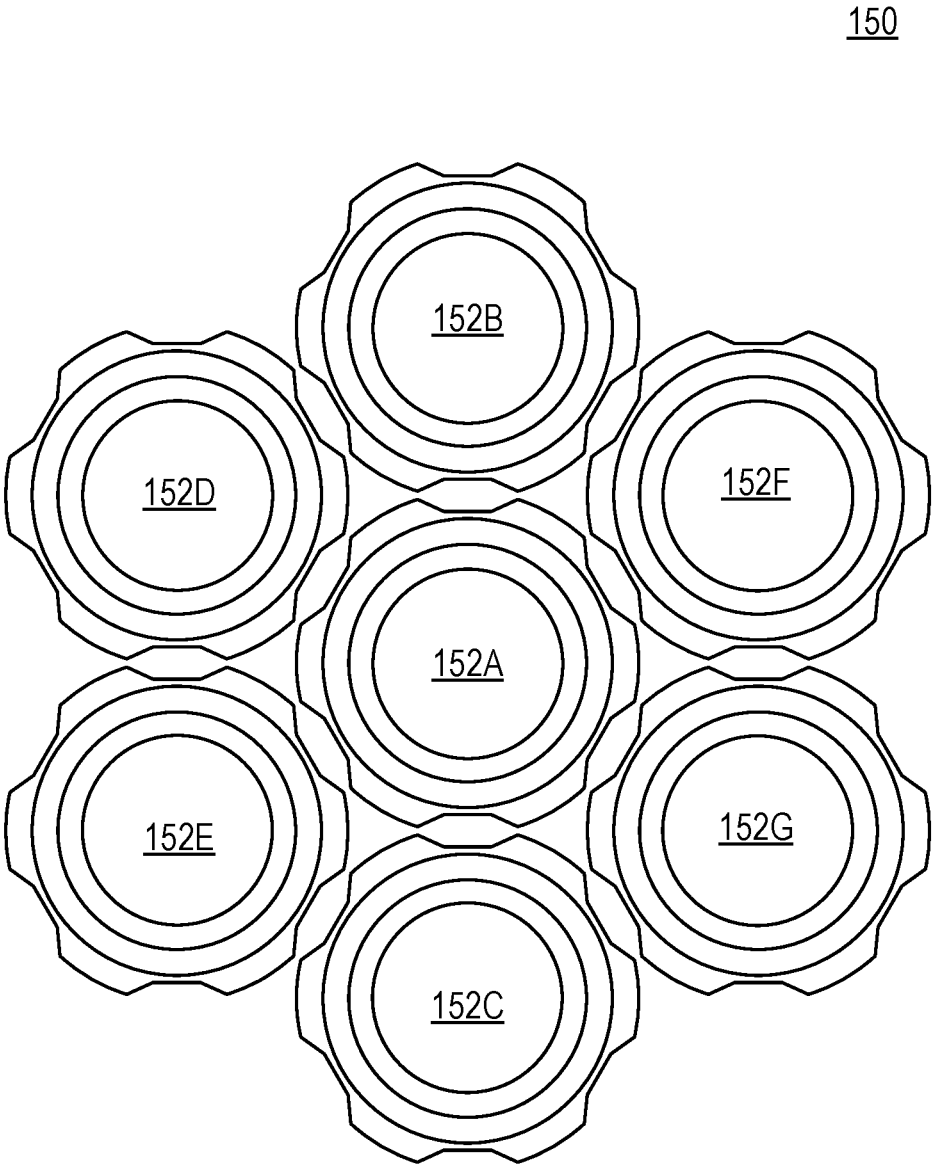
FIG. 1B illustrates an example top-view of a waveguide antenna array, according to an example embodiment.

FIG. 1B illustrates an example top-view of a waveguide antenna array 150, according to an example embodiment. The waveguide antenna array 150 shows one example arrangement of seven different waveguide antennas 152A-152G (such as waveguide antenna array element 100 of FIG. 1A) arranged in a tightly packed arrangement. Although, FIG. 1B only shows seven different waveguide antennas 152A-152G, the number of antennas in the array may vary from a single antenna up to hundreds of antennas. FIG. 1B illustrates one possible array arrangement. In other array arrangements, the antennas may be arranged based on a two dimensional grid where the centers of the antennas lie in columns and rows.

Because each antenna of the array has its own feed, the array may be able to steer the beam transmitted by the array. For example, if all the antennas of the array are fed in phase, then the array's beam will be broadside to a plane of the array. However, if the antennas are fed with specific out of phase signals, the beam may be steered. In an example array, the beam may be steered up to 30 degrees from the broadside direction. In other examples, the beam may be steered to angles greater than or less than 30 degrees.

As the scanning angle of an antenna array is changed, the impedance of the antenna element and/or array may change. As the scanning angle increases, an impedance locus (i.e., the imaginary portion of the antennas element's impedance) may increase significantly causing the antenna and/or array no longer radiate efficiently. For scanning over a narrow angular range, the change in antenna impedance may not be significant. Therefore, for small scanning ranges, additionally design criteria may not be need for the antenna to operate in an efficient manner. However, if larger scanning angles are desired, some additional design criteria may be used to increase the antenna and array efficiency.

Therefore, in some examples of the present disclosure, the antenna elements may also incorporate Wide-Angle Impedance Matching (WAIM) components and designs so the antenna operates correctly over wide steering angles. An example WAIM design element may include a dielectric sheet located on top of the antenna elements of an array. The dielectric sheet may allow the array to maintain a desired efficiency over a wider range of scanning angles than the array would without the dielectric. In additional examples, in applications where a higher range of beam steering is desired, the filters and/or waveguide may also include dielectric inserts, metallic posts, or magnetic posts as WAIM components to enable the array to operate over a desired range of steering angles with a sufficient efficiency. In some examples, one or more of the disclosed filters may include a dielectric material. The filter may be completely filled with dielectric or a dielectric layer may be added. Additionally, in some examples, additional filter elements (e.g., increasing from seven filter elements to eight or more filter elements) may also be used to increase the angular beam steering capabilities of the antenna.

Figure 2A:
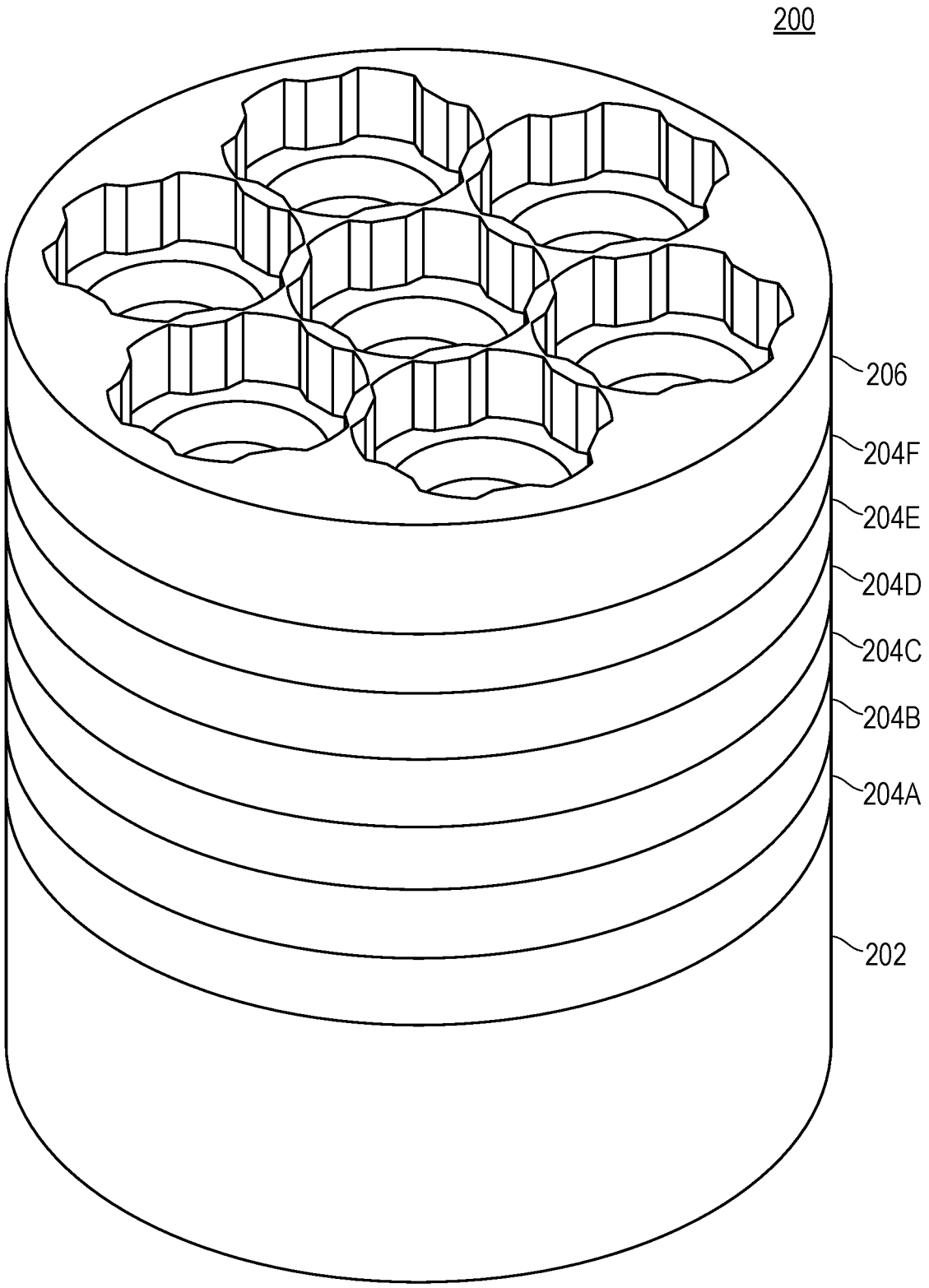
FIG. 2A illustrates an example stacked-construction waveguide antenna array, according to an example embodiment.

FIG. 2A illustrates an example of a stacked-construction waveguide antenna array 200, according to an example embodiment. The antenna array 200 may include a plurality of filter layers, such as eight layers, and may include an array of antennas (such as waveguide antenna array element 100 of FIG. 1A). The eight layers may be coupled together to form the stack-construction of antenna array 200. The stacked-construction of antenna array 200 may enable the manufacture of antenna array to be less complicated than other constructions. Further, as discussed with respect to FIG. 1B, the packing of array elements of antenna array 200 is merely one example, other possible array layouts for the antennas are possible too. Additionally, although antenna array 200 is shown with seven antennas, the number of antennas in the array may vary from a single antenna up to hundreds of antennas. Moreover, the number of layers may be varied as well. Generally, the number of layers may be equal to one more layer than the number of resonant cavities of the filter. Although, the number of layers may also be equal to the number of resonant cavities of the filter in some examples. In some yet further examples, there may be even more layers.

The bottom layer 202 may include, for each antenna of the array, a feed, a waveguide section, and a first resonant cavity. In some examples, the bottom layer may not include the feed, but rather the bottom layer may be configured to couple to a feed. A first middle layer 204A may include a first waveguide section between resonant cavities and a second resonant cavity. A second middle layer 204B may include a second waveguide section between resonant cavities and a third resonant cavity. A third middle layer 204C may include a third waveguide section between resonant cavities and a fourth resonant cavity. A fourth middle layer 204D may include a fourth waveguide section between resonant cavities and a fifth resonant cavity. A fifth middle layer 204E may include a fifth waveguide section between resonant cavities and a sixth resonant cavity. A sixth middle layer 204F may include a sixth waveguide section between resonant cavities and a seventh resonant cavity. The top layer 206 may include a seventh waveguide section between a resonant cavity and the horn. In some examples, the locations of the various components may be different. For example, the bottom layer 202 may not always include a resonant cavity. In some other examples, the top layer 206 may also contain a resonant cavity.

The layer construction may enable a computer numerical control (CNC) machine to create the various features of each layer out of a solid metal block. In some examples, rather than a solid metal block, a block of dielectric may be used as well. After each layer is created, the layers may be stacked together to form the antenna. Thus, through the CNC process, a large array may be created layer by layer which may reduce overall manufacturing complexity. Additionally, in some examples, WAIM components may be included within some or all of the layers.

Figure 2B:
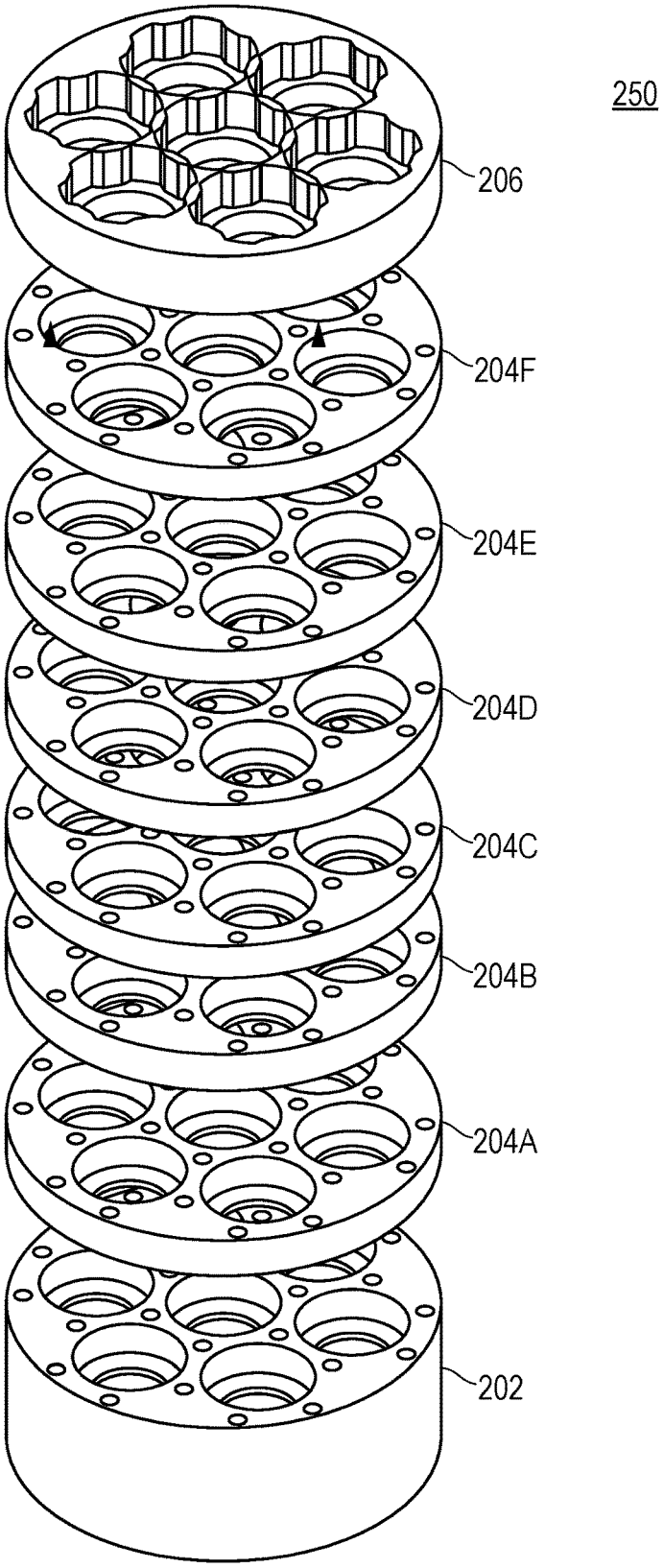
FIG. 2B illustrates an example expanded view stacked-construction waveguide antenna array, according to an example embodiment.

FIG. 2B illustrates an example expanded view 250 stacked-construction waveguide antenna array, according to an example embodiment. The expanded view 250 shows some of the components that form each layer of the antenna array 200 of FIG. 2A. The small dots on each layer may be holes and/or pins that are included on a given layer for alignment of the layers during antenna construction. For example, as discussed with FIG. 2A, the bottom layer 202 may include, for each antenna of the array, a feed, a waveguide section, and a first resonant cavity. In some examples, the bottom layer may not include the feed, but rather have a port to which a feed may be attached. A first middle layer 204A may include a first waveguide section between resonant cavities and a second resonant cavity. A second middle layer 204B may include a second waveguide section between resonant cavities and a third resonant cavity. A third middle layer 204C may include a third waveguide section between resonant cavities and a fourth resonant cavity. A fourth middle layer 204D may include a fourth waveguide section between resonant cavities and a fifth resonant cavity. A fifth middle layer 204E may include a fifth waveguide section between resonant cavities and a sixth resonant cavity. A sixth middle layer 204F may include a sixth waveguide section between resonant cavities and a seventh resonant cavity.

Figure 3A:
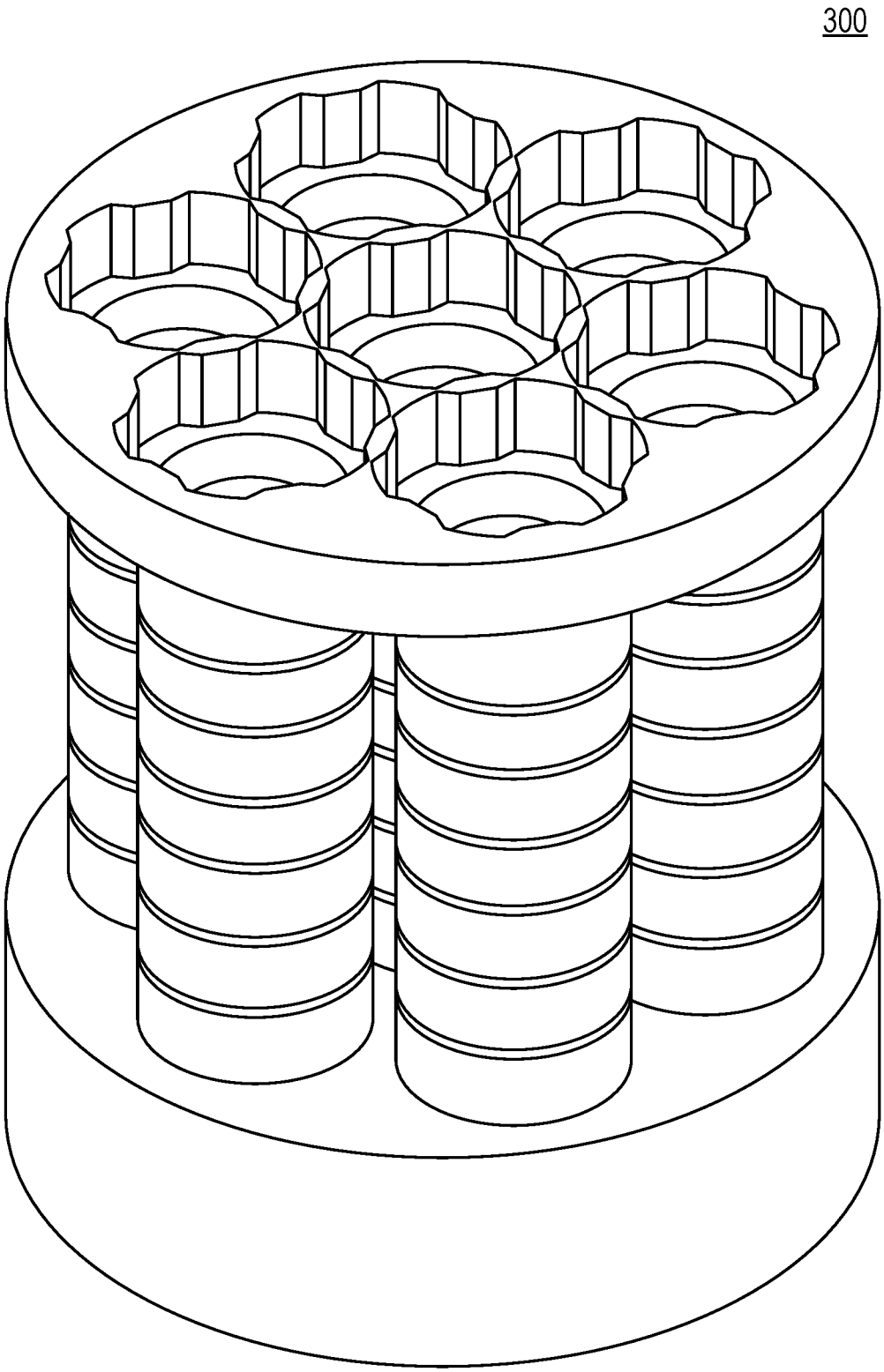
FIG. 3A illustrates an example additive-manufacturing waveguide antenna array, according to an example embodiment.
Figure 3B:
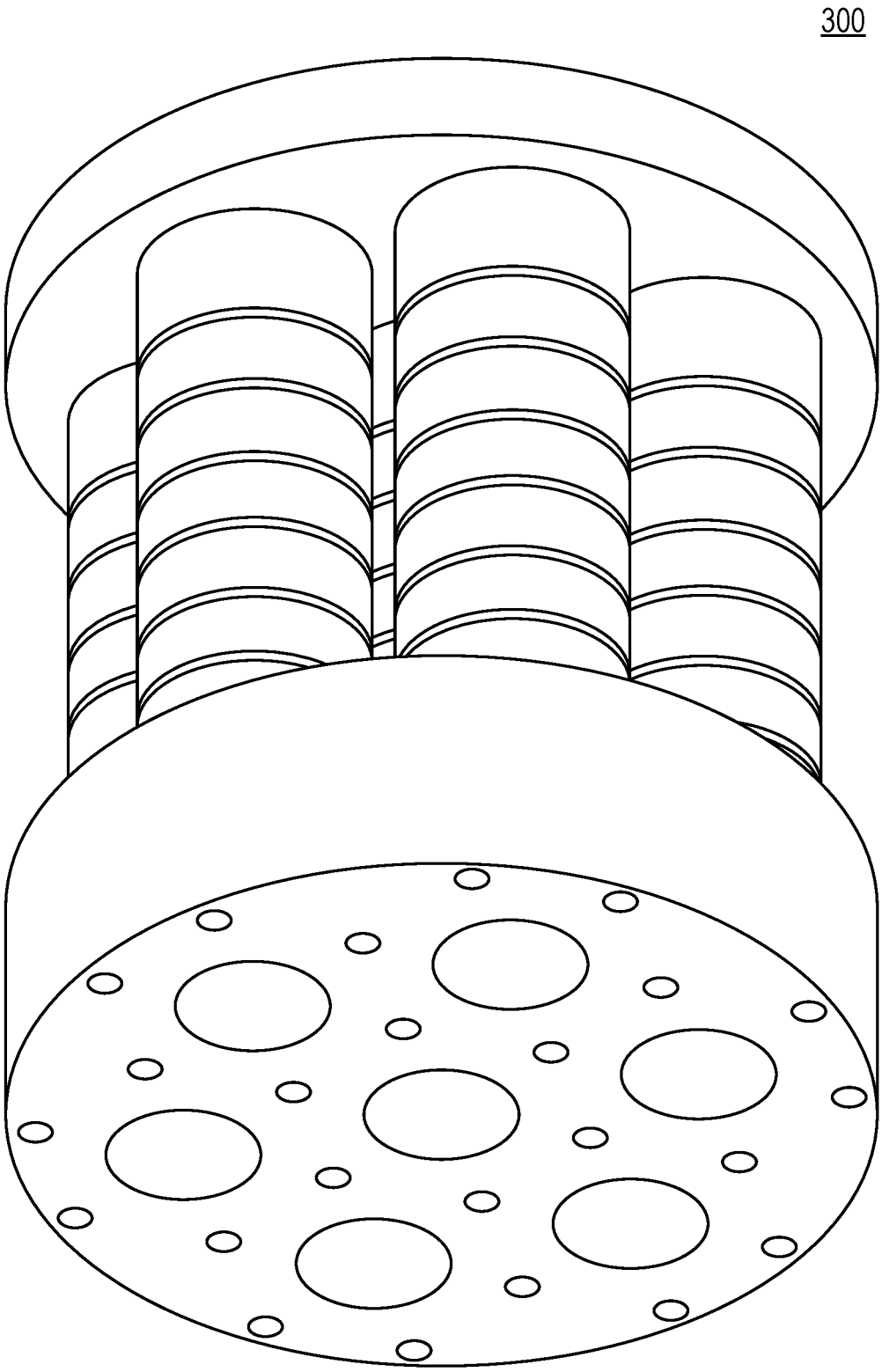
FIG. 3B illustrates a second view of an example additive-manufacturing waveguide antenna array, according to an example embodiment.

FIG. 3A illustrates an example of an additive-manufacturing waveguide antenna array 300, according to an example embodiment. FIG. 3B illustrates a second view of an example additive-manufacturing waveguide antenna array 300, according to an example embodiment. Additive manufacturing may also be known as 3D printing. When an antenna is built through an additive manufacturing process, material is built up to form the antenna, unlike the previously-described CNC process that removes material from a solid block. Because additive manufacturing builds up material to form the antenna, some shapes that are difficult and/or impossible to create through CNC processes may be formed. Additionally, the additive manufacturing process may use metal or a dielectric to build up the additive-manufacturing waveguide antenna array 300.

As shown with the additive-manufacturing waveguide antenna array 300, the amount of material needed to build the antenna may be less than what is used for the layered antenna of FIGS. 2A and 2B. By using less material, the antenna may be lighter and contain more open space. The weight reduction provided by additive manufacturing may be beneficial if the antenna is going to be mounted on a satellite where weight is critical. Additionally, and discussed further with respect to FIG. 4A, additive manufacturing may create an antenna array that includes open space between the various antenna elements of the array. This open space may be used to house various other components of the array system. In one example, electronics of the feed (not shown), such as radio components, that drive the antenna array may produce heat. A cooling system for the electronics may be integrated within the open space between the antenna elements. The cooling system may be able to remove heat from the electronics without taking up more space than the antenna array is allocated.

Similar to FIG. 2B, FIG. 3B shows alignment holes/pins on the bottom surface of the additive-manufacturing waveguide antenna array 300. The alignment holes/pins may be used to couple the additive-manufacturing waveguide antenna array 300 to a feed structure that includes a feed for each respective antenna element of the additive-manufacturing waveguide antenna array 300. Further, the bottom layer 202 of FIGS. 2A and 2B may also contain similar alignment holes/pins. Thus, the present antennas may be created independently of the feed structure and coupled to the feed structure during assembly of the final antenna structure.

Figure 4A:
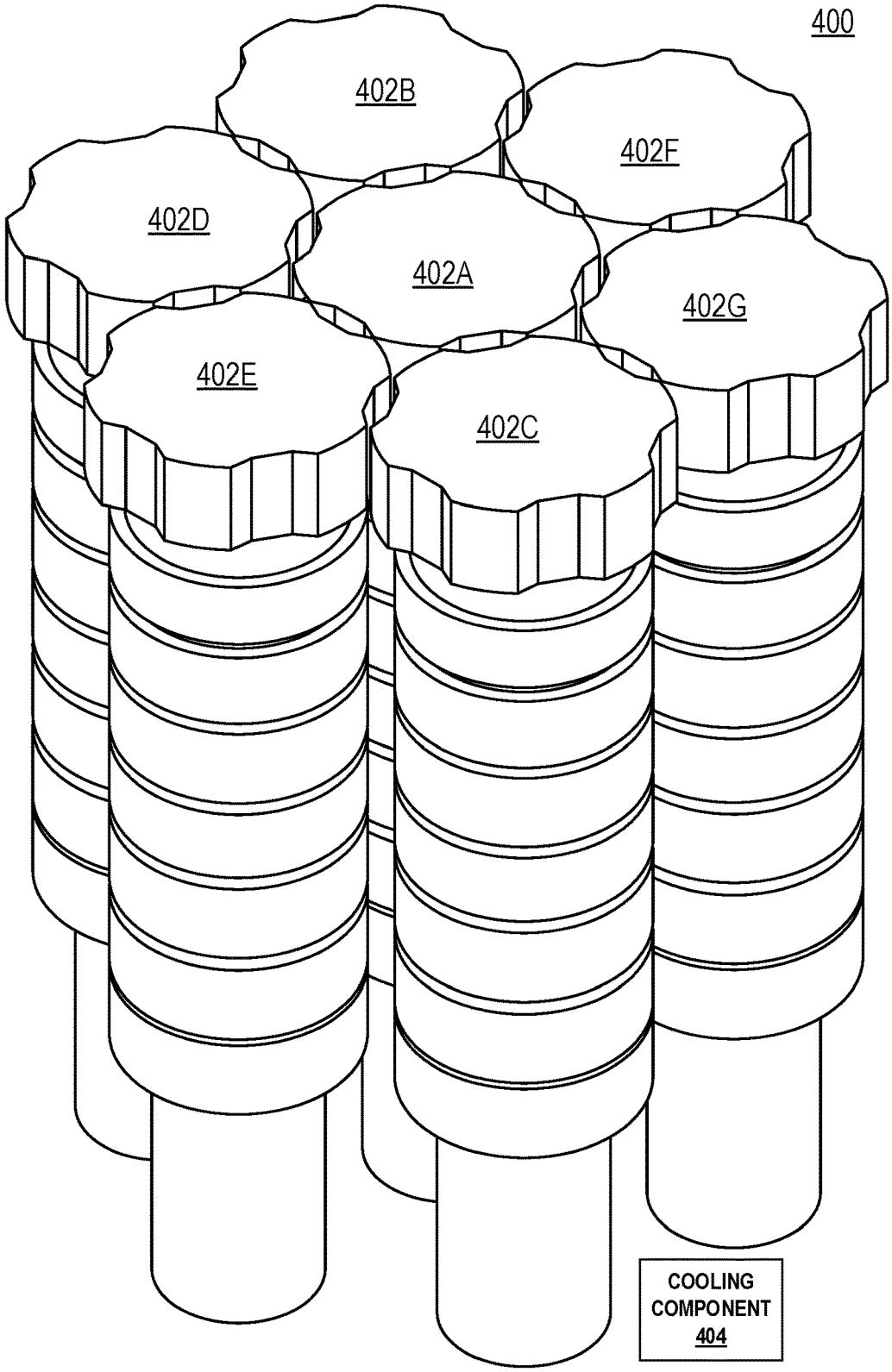
FIG. 4A illustrates an example waveguide antenna array, according to an example embodiment.

FIG. 4A illustrates an example of a waveguide antenna array 400, according to an example embodiment. The waveguide antenna array 400 includes seven antennas 402A-402G arranged in an array similar to the array described with respect to FIG. 1B. Each of the seven antennas 402A-402G may be similar to waveguide antenna array element 100 of FIG. 1A. The seven antennas 402A-402G show the negative space (i.e., the empty space of the waveguide) that forms each antenna. The seven antennas 402A-402G may be the antennas for the arrays of FIGS. 2A, 2B, 3A, and/or 3B. As shown in FIG. 4A, a cooling component 404 may be located within the space between the various antenna elements. The cooling component 404 may be a heatsink and/or a fluid-filled system of tubes. The cooling component 404 may be configured to remove heat from the electronics that provide electromagnetic signals for radiation by the antenna elements.

Figure 4B:
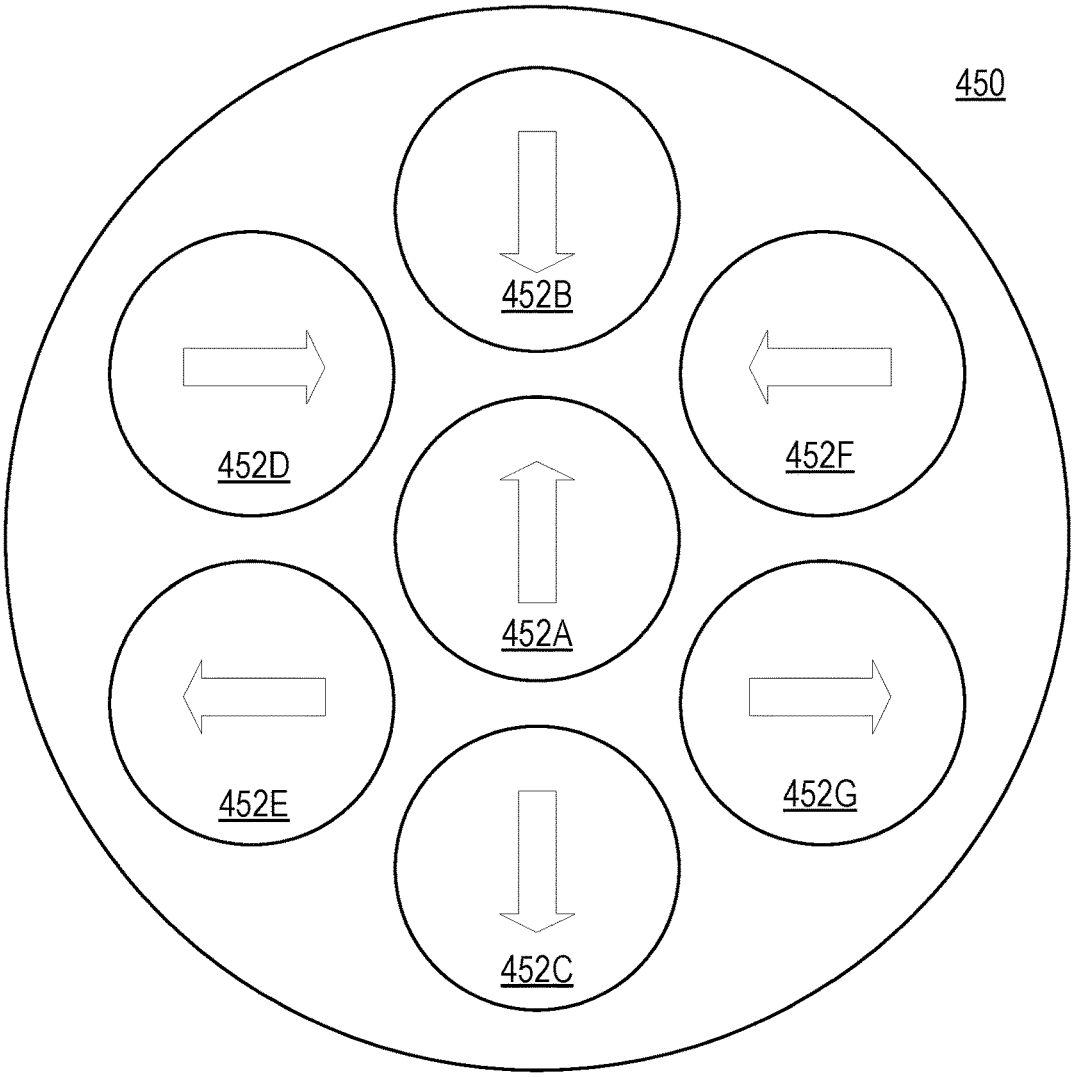
FIG. 4B illustrates an example waveguide antenna array feed layout, according to an example embodiment.

FIG. 4B illustrates an example of a waveguide antenna array feed layout 450, according to an example embodiment. The waveguide antenna array feed layout 450 includes seven antenna feeds 452A-452G to correspond to the seven example antennas of the other disclosed arrays. The number of feeds may be equal to the number of antennas in any given antenna (as the number of antenna elements in practice may be greater than or fewer than seven). Each of the seven feeds may have an orientation indicated by the arrow within the respective feed. Additionally, the waveguide antenna array feed layout 450 may be coupled to a bottom of the antenna array structures that are previously disclosed. When the waveguide antenna array feed layout 450 is coupled to the array structure, the feeds may be able to launch electromagnetic energy into a respective waveguide.

Figure 4C:
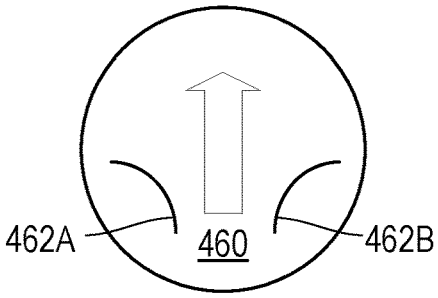
FIG. 4C illustrates an example feed having two ports, according to an example embodiment.

Further, each feed of the seven antenna feeds 452A-452G may have two ports, each configured to provide an electromagnetic signal to the respective waveguide from the feed. FIG. 4C illustrates an example feed 460 having two ports 462A and 462B. The example feed 460 may be the same as the seven antenna feeds 452A-452G, but with more detail shown in the figure. The example feed 460 has an orientation indicated by the arrow in the center of the feed. The orientation here is defined by the two ports 462A and 462B. As shown in FIG. 4B, the rotations for a given feed may include a rotation so adjacent feeds do not include the same orientation. Because the feeds are not rotationally symmetric, providing a rotation of the orientation may enable the array to have better far field performance.

Each port of two ports 462A and 462B may be configured to launch electromagnetic energy into the respective waveguide with a polarization. The polarization introduced by each of the two ports 462A and 462B may be different than the polarization introduced by the other feed. In some examples, the two polarizations may be orthogonal to one another. Thus, if the polarizations are orthogonal, each port of the two ports 462A and 462B may launch a respective signal as electromagnetic energy into the respective waveguide and because of the orthogonality, the two signals will stay independent. Therefore, the orthogonality may provide two different channels through a single antenna.

Further, the signals provided by the two ports 462A and 462B may be independently controlled. Thus, each feed may be selectively enabled or disabled. Therefore, the antenna may be able to transmit signals from the first port, transmit signals from the second port, or transmit signals from both the first port and the second port simultaneously. In another example, a radio controller may be able provide a phasing across the all the ports of the feeds of the array to steer the beam transmitted by the array. In some examples, a beam with the first polarization may be steered independent of the steering of the beam that has the second polarization. Each of the two ports 462A and 462B may be a strip of metal that launches the electromagnetic wave. One end of each of the two ports 462A and 462B may be coupled to electronics located on a circuit board of the feed. The electronics may provide the signals for each of the two ports 462A and 462B to radiate.

Additionally, as previously discussed with respect to FIG. 1A, the antenna element may include a simulation plane 110. The simulation plane 110 may be the point where the feed structure couples to the waveguide. In other examples, the simulation plane 110 may be any plane chosen along the length of the waveguide. Further, although the simulation plane 110 is shown in FIG. 1A, the concepts discussed are equally applicable to the disclosed antenna arrays and other antenna arrays.

When designing antenna systems (and antenna arrays) electromagnetic simulation tools may be used to simulate the performance and characteristics of the antennas. The simulation may provide information about the antenna array, such as impedance, radiation pattern, etc. However, simulations may be computationally intensive. Simulations may use the finite element analysis methods to simulate the antenna and array performance. As the number of elements and the physical size of the array increases, simulations may become exceedingly computationally intensive.

In order to reduce the complexity of simulating the antenna and/or array, the simulation plane 110 may be used. The simulation plane 110 may enable two simulations to be run to determine the antenna and/or array properties and performance. One simulation may be performed on the feed portion below the simulation plane 110 line. A second simulation may be performed on the on the radiating portion above the simulation plane 110 line. Thus, after each portion has been simulated, the results may be combined to determine full system performance. Further in other examples, a plurality of simulations may be performed and combined to determine an optimal array or an array with desired criteria. In one example, numerous simulations may be performed with various rotations for the feeds. These simulations may be combined with various simulations of different radiating portions to optimize the final array design. The simulation plane 110 is one way to divide the simulation into smaller, less computationally intense simulations.

Figure 5:
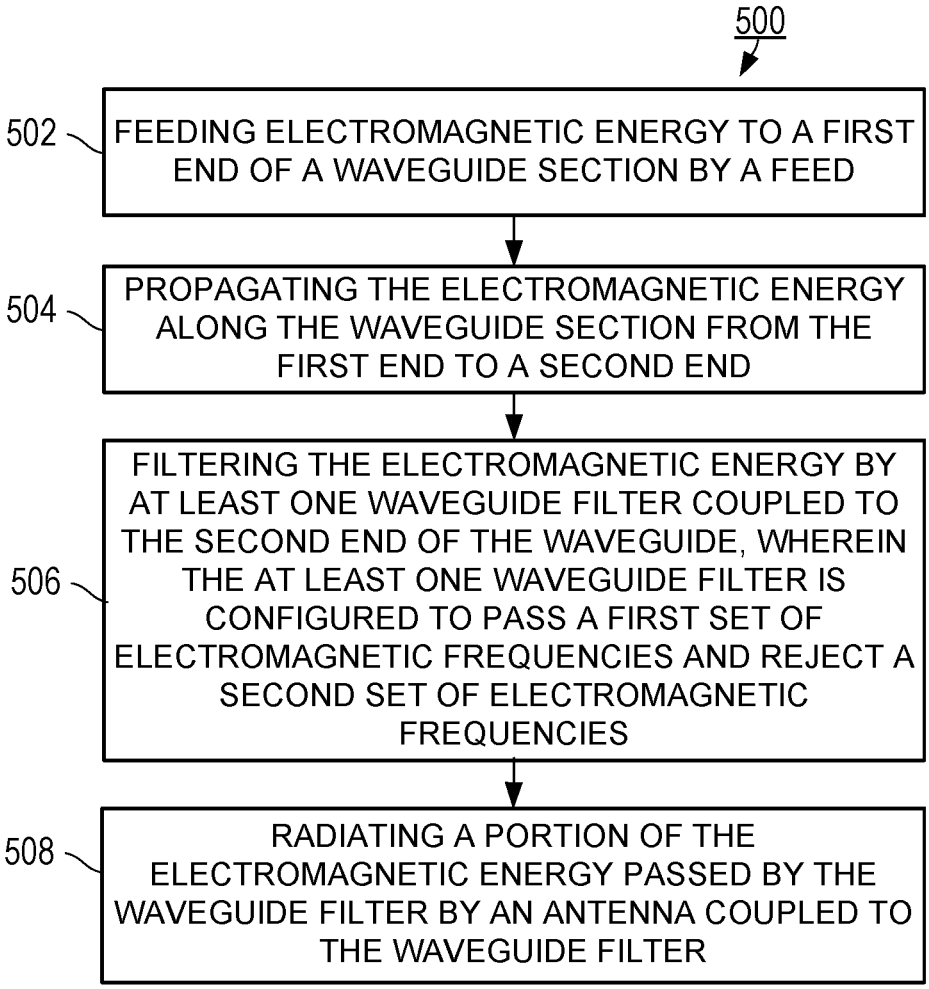
FIG. 5 shows a flowchart of an example method of operating an antenna system, according to an example embodiment.

FIG. 5 shows a flowchart of an example of a method 500 of operating an antenna system, according to an example embodiment. Method 500 may be used with or implemented by the systems shown in FIGS. 1-4B. Although method 500 is described with respect to a single antenna, it may be expanded for use with multiple antennas, such as in the waveguide antenna array 150 including the seven waveguide antennas 152A-152G of FIG. 1B. For example, blocks 502-508 may be performed in parallel by a plurality of antennas in an array. In some examples, method 500 may be performed simultaneously by all the antennas of the array. In other examples, only a subset of the antennas may perform method 500. Antennas that perform method 500 may be selected based on a desired radiation pattern for the array.

In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner. Method 500 may include one or more operations, functions, or actions as illustrated by one or more of blocks 502-508. Also, the various blocks may be combined into fewer blocks, divided into additional blocks, and/or removed based upon the desired implementation.

It should be understood that for this and other processes and methods disclosed herein, flowcharts show functionality and operation of one possible implementation of present embodiments. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

At block 502, the method 500 includes feeding electromagnetic energy to a first end of a waveguide section by a feed 104. As previously disclosed, the feed is configured to receive a signal from electronic components and launch the signal as electromagnetic energy into a waveguide section. In some examples, the feed may have one or more ports (462A, 462B) through which the signal is fed. The port may include a metallic component, such as a wire, probe, or patch antenna that launches the electromagnetic energy into the waveguide section. Additionally, the electromagnetic energy may be launched with a given polarization. In some examples, the feed may include two ports, each configured to launch electromagnetic energy having a given polarization. The polarization of the two ports may be orthogonal to one another.

Additionally, the method may also include cooling electronics of the feed structure by a cooling component 404. Because the electronics generate heat during their operation, it may be desirable to provide cooling to the electronics. In some examples, a cooling component may be located within the antenna structure to provide cooling to the electronics.

In some examples, when method 500 is being performed by a plurality of antennas in an array, feeding electromagnetic energy may further include feeding electromagnetic energy with a respective phase for each feed. By feeding electromagnetic energy with a respective phase for each feed, steering of the beam transmitted by the array may be adjusted. In some examples it may be desirable for the beam to include steering of up to 30 degrees from broadside. In some other examples, steering angles greater or less than 30 degrees may be desired as well. Additionally, in some examples, each feed may have an associated rotation. Due to the feeds not being symmetric, the rotations for a given feed may include a rotation so adjacent feeds of different antenna elements of an array do not include the same orientation. Because the feeds are not rotationally symmetric, providing a rotation of the orientation may enable the array to have better far field performance.

At block 504, the method 500 includes propagating the electromagnetic energy along the waveguide section from the first end to a second end. The waveguide section is configured to enable the propagation of the electromagnetic energy that the port of the feed provides to a first end of the waveguide section. The waveguide section may enable a lossless (or relatively lossless) propagation of energy from the feed to the filter. The waveguide may be a hollow air-filled waveguide. In some examples, the waveguide may be a cylindrical waveguide. Additionally, in some examples, the waveguide may be constructed through an additive manufacturing process, as described with respect to FIG. 3, or a layered manufacturing process, as described with respect to FIGS. 2A and 2B. For additive manufacturing processes, the waveguide, filter(s), and antenna may be made as one unit. For layered manufacturing processes, the waveguide section may be one layer. The waveguide layer may be coupled to one or more filter layers and an antenna layer. In some examples, the waveguide layer may also include a filter.

At block 506, the method 500 includes filtering the electromagnetic energy by at least one waveguide filter coupled to the second end of the waveguide section, wherein the at least one waveguide filter is configured to pass a first set of electromagnetic frequencies and reject a second set of electromagnetic frequencies. The filter is coupled to a second end of the waveguide section. The filtering is performed by a plurality of air-filled waveguide cavities. In some examples, a single air-filled resonant waveguide cavity may perform the filtering. In other examples, many air-filled waveguide cavities may perform the filtering.

Additionally, in some examples, the filtering is performed by a bandpass filter made up of air-filled waveguide cavities configured to filter the signals in a bandpass manner. In some examples, the bandpass filter may be configured to pass signals that have frequencies between 17.7 to 20.2 gigahertz (GHz) and stop signals that have frequencies less than or equal to 15.4 GHz and greater than or equal to 22.2 GHz.

The number of air-filled waveguide cavities and the dimensions of each respective air-filled waveguide cavities may be designed based on a desired filtering criteria. For example, filtering bandwidth, passband frequencies, stopband frequencies, and filter roll off may all be adjusted based on the number of and dimensions of the respective air-filled waveguide cavities. In some examples, the filtering may also include some WAIM components, as previously described, to enable larger steering angles for the antenna array.

At block 508, the method 500 includes radiating a portion of the electromagnetic energy passed by the waveguide filter by an antenna coupled to the waveguide filter. In some examples, the antenna may be a waveguide horn antenna. The waveguide horn antenna may have dimensions and a shape that give it desired radiation properties. For example, the horn may include protrusions that reduce transmission of higher order modes and reduce coupling to adjacent antennas. In addition, the waveguide horn may be designed to enable a desired beam steering when the antenna elements are used in an array. In one example, it may be desirable for the beam to be steered over a 30 degree angular arc. However, in other examples, the beam steering may be angles greater or less than 30 degrees.

By the term "substantially", "about", and "approximately" used herein, it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Different examples of the system(s), device(s), and method(s) disclosed herein include a variety of components, features, and functionalities. It should be understood that the various examples of the system(s), device(s), and method(s) disclosed herein may include any of the components, features, and functionalities of any of the other examples of the system(s), device(s), and method(s) disclosed herein in any combination or any sub-combination, and all of such possibilities are intended to be within the scope of the disclosure.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of radiating an electromagnetic signal by a plurality of radiating elements arranged in an array, wherein a plurality of filter layers are arranged in a stacked-construction forming the plurality of radiating elements arranged in the array, wherein each layer of the plurality of filter layers is a discrete component and wherein the method comprises:

for each radiating element, feeding electromagnetic energy to a first end of a waveguide section by a feed, wherein the waveguide section and the feed for each radiating element is included in a first layer of the plurality of filter layers;

propagating the electromagnetic energy along the waveguide section from the first end to a second end;

filtering the electromagnetic energy by at least one waveguide filter coupled to the second end of the waveguide, wherein the at least one waveguide filter is configured to pass a first set of electromagnetic frequencies and reject a second set of electromagnetic frequencies, wherein the at least one waveguide filter for each radiating element is included in a second layer of the plurality of filter layers; and radiating a portion of the electromagnetic energy passed by the at least one waveguide filter by an antenna coupled to the waveguide filter, wherein the antenna for each radiating element is included in a third layer of the plurality of filter layers.

2. The method of claim 1, wherein filtering is performed by a plurality of resonant waveguide cavities.

3. The method of claim 2, wherein the waveguide filter comprises the plurality of resonant waveguide cavities for each radiating element.

4. The method of claim 3, wherein the waveguide filter for each radiating element is comprised of multiple layers of the plurality of filter layers, and each of the plurality of resonant waveguide cavities are included in a discrete layer of the plurality of filter layers.

5. The method of claim 1, further comprising cooling electronics of the feed by a cooling component.

6. The method of claim 1, wherein radiating a portion of the electromagnetic energy is performed by a waveguide horn antenna.

7. The method of claim 1, wherein filtering is a bandpass filtering.

8. The method of claim 1, wherein the first set of electromagnetic frequencies comprises frequencies between 17.7 to 20.2 gigahertz (GHz) and wherein the second set of electromagnetic frequencies comprises at least one of 15.4 GHz and 22.2 GHz.

9. The method of claim 1, wherein each of the plurality of filter layers includes holes for alignment of the plurality of filter layers.

10. A waveguide antenna array comprising:

a plurality of filter layers arranged in a stacked-construction forming a plurality of radiating elements arranged in an array, wherein each layer of the plurality of filter layers is a discrete component, wherein each radiating element comprises:

a waveguide section having a first end and second end, wherein the waveguide section is configured to propagate electromagnetic energy, wherein the waveguide section for each radiating element is included in a first layer of the plurality of filter layers;

a feed configured to launch an electromagnetic wave into the first end of the waveguide section, wherein the feed for each radiating element is included in the first layer of the plurality of filter layers;

a waveguide filter comprising at least one resonant waveguide cavity coupled to the second end of the waveguide section, wherein the waveguide filter is configured to pass a first set of electromagnetic frequencies and reject a second set of electromagnetic frequencies, wherein the waveguide filter for each radiating element is included in a second layer of the plurality of filter layers; and an antenna coupled to the waveguide filter configured to radiate a portion of the electromagnetic energy passed by the waveguide filter, wherein the antenna for each radiating element is included in a third layer of the plurality of filter layers;

wherein, the feed of each radiating element has an associated rotation based on a location of the antenna in the array.

11. The waveguide antenna array of claim 10, wherein the rotation of a given feed is different than the rotation of the feed of each adjacent radiating element.

12. The waveguide antenna array of claim 10, wherein the waveguide array is constructed through a layered manufacturing process, wherein the layers comprise:

the first layer comprising the waveguide section and a first cavity of the at least one waveguide cavities, wherein the first layer is configured to couple the feed to the first waveguide section.

13. The waveguide antenna array of claim 12, wherein each filter layer comprises an air-filled waveguide cavity.

14. The waveguide antenna array of claim 10, further comprising a cooling system configured to cool electronics of the feeds.

15. The waveguide antenna array of claim 10, wherein each of the plurality of filter layers includes holes for alignment of the plurality of filter layers.

16. The waveguide antenna array of claim 10, wherein the waveguide filter comprises a plurality of resonant waveguide cavities for each radiating element.

17. The waveguide antenna array of claim 16, wherein the waveguide filter for each radiating element is comprised of multiple layers of the plurality of filter layers, and each of the plurality of resonant waveguide cavities are included in a discrete layer of the plurality of filter layers.

18. The waveguide antenna array of claim 10, wherein the antenna for each radiating element is a waveguide horn antenna.

19. The waveguide antenna array of claim 10, wherein the waveguide filter for each radiating element is a bandpass filter.

20. The waveguide antenna array of claim 10, wherein the first set of electromagnetic frequencies comprises frequencies between 17.7 to 20.2 gigahertz (GHz) and wherein the second set of electromagnetic frequencies comprises at least one of 15.4 GHz and 22.2 GHz.

* * * * *